US005596860A

United States Patent [19]

Hacker

[11] Patent Number: 5,596,860

[45] Date of Patent: Jan. 28, 1997

[54] FOAMED CEMENT INSULATED METAL FRAME BUILDING SYSTEM

[75] Inventor: John H. Hacker, Cathedral City, Calif.

[73] Assignees: Insu-Form Incorporated, Cathedral City, Calif.; Omega Transworld, Ltd., New Kensington, Pa.

[21] Appl. No.: 304,011

[22] Filed: Sep. 9, 1994

[51] Int. Cl.[6] ..... E04B 2/08

[52] U.S. Cl. ..... 52/763; 52/92.1; 52/296; 52/248; 52/606; 52/309.12; 52/667

[58] Field of Search ..... 52/92.1, 309.12, 52/762, 763, 764, 606, 667, 262, 298, 293.3, 92.2, 93.1, 295, 296, 243

[56] References Cited

U.S. PATENT DOCUMENTS

| | | | |
|---|---|---|---|
| 2,250,319 | 7/1941 | Wright . | |
| 3,750,355 | 8/1973 | Blum . | |
| 3,759,009 | 9/1973 | Ransome . | |
| 3,960,999 | 6/1976 | Massie . | |
| 4,029,037 | 6/1977 | Hogan . | |
| 4,031,285 | 6/1977 | Miller et al. . | |
| 4,052,829 | 10/1977 | Chopman | 52/285 |
| 4,098,040 | 7/1978 | Riefler . | |
| 4,132,043 | 1/1979 | Juba . | |
| 4,179,858 | 12/1979 | Graham et al. | 52/262 |
| 4,232,489 | 11/1980 | Corvington et al. . | |
| 4,304,080 | 12/1981 | Freeman . | |
| 4,441,944 | 4/1984 | Massey . | |
| 4,453,357 | 6/1984 | Zwilgmeyer . | |
| 4,486,993 | 12/1984 | Graham et al. . | |
| 4,503,677 | 3/1985 | Crumb et al. . | |
| 4,524,553 | 6/1985 | Hacker | 52/169.11 |
| 4,532,745 | 8/1985 | Kinard | 52/251 |
| 4,774,794 | 10/1988 | Grieb | 52/309.7 |
| 4,899,498 | 2/1990 | Grieb . | |
| 4,924,641 | 5/1990 | Gibbar . | |
| 4,936,069 | 6/1990 | Hunter et al. . | |
| 4,965,980 | 10/1990 | Leavens | 52/92.2 X |
| 5,150,885 | 9/1992 | Leone | 52/667 X |
| 5,163,186 | 11/1992 | Dolder . | |
| 5,178,941 | 1/1993 | Wu | 428/309.9 |
| 5,245,810 | 9/1993 | Foss | 52/405 |
| 5,249,401 | 10/1993 | Schmid . | |
| 5,274,973 | 1/1994 | Liong | 52/667 X |
| 5,311,708 | 5/1994 | Frye | 52/92.2 X |
| 5,329,741 | 7/1994 | Nicolaidis et al. . | |

FOREIGN PATENT DOCUMENTS

| | | | |
|---|---|---|---|
| 420033 | 6/1947 | Italy | 52/92.1 |

OTHER PUBLICATIONS

Andrews, Steve, "All In The Wall", *Builder*, pp. 219–222, May 1989.

Hufnagel, James, "Foam–Core Panels Speedy, High–R Alternatives to Stud Framing", *Better Homes and Gardens*, Mar. 1989.

The R–Control® Panel Building System brochure (3 pages), undated.

*Primary Examiner*—Carl D. Friedman
*Assistant Examiner*—W. Glenn Edwards
*Attorney, Agent, or Firm*—Trask, Britt & Rossa

[57] ABSTRACT

A metal frame insulated building system using metal studs and sole and cap blocking tracks of "C" cross-section anchored to a foundation and to each other. The studs and cap blocking tracks physically interlocked in addition to being mutually secured by fasteners. Vertical stacks or columns of foamed cement blocks are placed between the studs and grooves on one or both sides of the blocks receive stud flanges to interlock the studs and blocks. The bottom and top blocks of a stack similarly interlock via grooves with the blocking track flanges. The blocks protrude beyond the studs on the structure's exterior, substantially covering the stud and blocking track flanges and attenuating thermal conductivity as well as providing an exterior surface for stucco or other finish.

22 Claims, 4 Drawing Sheets

FOAMED CEMENT INSULATED METAL FRAME BUILDING SYSTEM

BACKGROUND OF THE INVENTION

1. Field of the Invention

The present invention relates generally to building systems for residential, commercial and industrial structures, and more specifically to a metal frame building system having increased structural strength, superior thermal and acoustic insulating properties, and enhanced resistance to fire and pests.

2. State of the Art

Steel building frames have been employed for many decades in commercial and industrial buildings. In the past few years, the traditional column and beam construction typically employed in such buildings has been adapted to residential construction due to its resistance to earthquakes, hurricanes, termites and other pests, as well as its ability to accommodate enhanced insulation and to afford a wide variety of floor plans due to the fact that the interior walls are not load-beating. Such framing systems, however, require a large capital investment in lifting equipment for column and beam placement, as well as welding equipment and factory production of custom-length beams and columns for subsequent assembly on site.

Another type of metal frame building system is based upon the traditional "stick-built" wood structure, wherein a wood frame comprising sole plates, cap plates and vertical studs extending therebetween on sixteen- or twenty-four-inch centers is topped with a wood rafter or prefabricated truss roof system. As the cost of wood framing escalates due to timber harvesting restrictions coupled with increased domestic and foreign demand, and the quality of framing wood continues to deteriorate, a number of builders have elected to use steel or even sometimes aluminum framing members in lieu of wood. These metal framing members are screwed or sometimes welded together to define the structure's frame, traditional fiberglass batt insulation installed, interior drywall and exterior siding applied, and the structure topped with a conventional roof. While such structures offer enhanced fire resistance, pest resistance and some increase in strength as compared to a wood-framed structure, their full potential for enhanced strength to resist earthquake and wind forces has not been realized as the framing members do not interlock to any appreciable degree, the welds or fasteners between the members providing the sole connections and thus being the limiting factor in the structure's strength. Furthermore, the assembled frame as described is not securely tied to the footings or foundation. In addition, the use of conventional fiberglass insulation provides no advantage whatsoever over a wood-framed, similarly-insulated structure. The metal framing elements in fact act as conductive paths for heat loss and heat gain between the interior and exterior of the structure. Conventional insulation also fails to provide any thermal mass to moderate large, daily, exterior ambient temperature swings such as are often experienced in desert and mountain climates.

It is known to use foam board on the exterior of such metal stud-framed walls for insulation enhancement and reduction in air infiltration or a barrier wrapping such as Tyvek™ fabric to reduce air infiltration. It is also known to insulate the wall cavities with blown and glued-in insulation or in situ-generated foam insulation. Such techniques provide some obvious advantages, but all require additional or more expensive materials, as well as additional labor and/or equipment. In some markets this is acceptable, but in many areas, homes affordable to even middle-class buyers must omit such enhancements due to cost concerns. For low-cost domestic housing or housing in developing countries, such enhancements are out of the question due to scarcity of local materials and high shipping costs if the necessary materials are procured elsewhere.

It would be highly advantageous to offer the contractor and home buyer a metal frame building system which would use commercially available framing members of standard dimensions and lengths, yet provide a high degree of framing member interlocking which is not fastener-dependent. Such a framing system would be even more beneficial if provided with an anchoring system of commensurate strength to tie the frame to the footing or foundation. It would also be desirable to combine such a framing system with an insulating system which provides a high R-factor, reduces air infiltration, removes or highly attenuates thermal conductivity through the framing members between the structure's interior and exterior, provides thermal mass to the walls, provides an easily-finished exterior surface which avoids the need for siding, masonry or even an underlayment for stucco, provides additional structural stiffness and can be installed using manual labor and standard contractor's tools. To date, however, such a building system is unknown in the art, despite many attempts to develop same.

SUMMARY OF THE INVENTION

The present invention comprises a metal frame building system employing interlocking vertical studs supported and capped by horizontal blocking tracks, the frame being secured by bolts and straps to a poured-concrete footing. Foamed cement blocks are stacked between and interlock with the studs to define the structure's exterior walls. The blocks protrude beyond and substantially cover the exterior stud faces, while terminating within the interior stud faces so as to permit securement of drywall or other interior wall surfacing to the studs. One or more blocks or rows of blocks may contain grooves or channels aligned with holes through the studs for receiving electrical wiring or water pipes. The blocks on the bottom row interlock with the sole blocking track, while blocks on the uppermost row interlock with the cap blocking track.

More specifically, the metal frame building system of the invention employs a poured concrete perimeter footing in which is embedded a framing anchor system including a series of J-bolts which preferably interlock with brackets, straps and rebar also disposed in the footing, the specific design of the anchor system being hereinafter described in greater detail.

The framing system of the present invention preferably comprises studs and blocking tracks of a "C" cross-section, the lowermost or sole blocking track facing upwardly and being secured to the footing via the aforementioned bolts and straps. The studs, which may be employed singly in single-story structures or preferably back-to-back in multiple-story structures, are also secured to the footing by fasteners affixed through the aforementioned straps. The studs extend upwardly through apertures cut in the cap blocking track, the apertures being cut in an "H" pattern so as to provide tabs when bent out of the plane of the track for securement of the track to the studs with fasteners. Metal rafters and ceiling joists, or alternatively prefabricated trusses, also comprising C-section structural members, rest on the blocking cap track and are secured to the stud ends extending thereabove. Other structural members such as the end plates secured to the outer ends of the rafters may similarly be formed of blocking track, H-cut to receive the rafter ends and provide tabs for use of fasteners. In two-story buildings at least one of the paired studs extends through a second-story, sole blocking track and a second-story, cap blocking track, the roof framing members resting on the latter and secured to the uppermost stud ends.

The insulation system of the present invention comprises vertical inter-stud stacks of foamed cement blocks grooved on one or both sides so as to interlock with one of the legs of the C-section studs and protrude beyond the exterior of the stud, substantially covering it. The groove is placed so that the interior side of the block terminates immediately inside of the interior flange of the stud, the stud flange thus providing an interior surface for affixation of drywall or other interior surfacing over the blocks, which are substantially flush with the stud flanges. The bottom block in each stack is also grooved on its bottom to accommodate the exterior leg of the upwardly-facing sole blocking track, while the top block in each stack is grooved to accommodate the exterior leg of the downwardly-facing cap blocking track. If back-to-back studs are employed, each block interlocks with at least two studs. If single studs are employed, each block interlocks at least with one stud, and snugly abuts another stud.

The structure as described above is subsequently roofed in a conventional manner and the exterior walls thereof, consisting essentially of the foamed cement block up to the soffit, may be filled between columns or stacks of block and finished with a conventional synthetic stucco or other siding material as desired. Windows and doors are framed in using studs and plates as with conventional frame construction, and may be trimmed in by conventional methods. The interior and exterior of the resulting structure is visually indistinguishable from conventional wood- or metal-framed structures.

The structure of the present invention resulting from the integrated framing anchor system, metal framing system and insulating system as described above provides superior strength against earthquake and high wind forces, resists against termites and other pests, and is rot-proof, extremely fire-resistant, and highly insulated in both thermal and acoustic respects, as well as substantially eliminating air infiltration through the walls. In addition, the presence of the foamed cement block provides a large thermal mass to moderate exterior ambient temperature swings, for further comfort and utility savings.

Moreover, the structure of the present invention may be easily erected on any site using entirely conventional techniques and tools, and requiring only manual labor. The components of the structure are modest in cost, especially compared to any building system offering competitive advantages. Using the aforementioned conventional construction techniques and tools, a structure using the building system of the invention may thus be erected at a cost very competitive to conventional wood stud-framed structures and purchased at an overall cost, including long-term financing, utilities and insurance, which is equivalent or better.

DETAILED DESCRIPTION OF THE ILLUSTRATED EMBODIMENT

Figure 1:
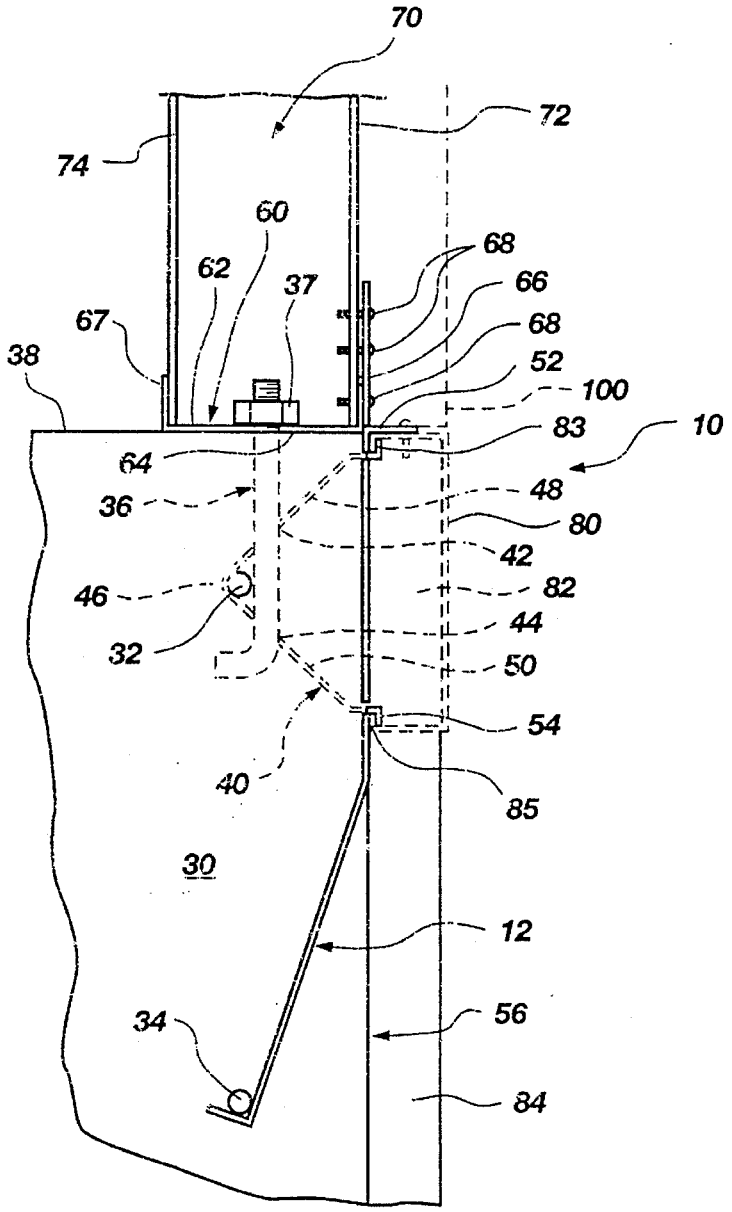
FIG. 1 is a side sectional elevation of a concrete footing having disposed therein the framing anchor system of the present invention, with metal sole plate and stud secured thereto.
Figure 2:
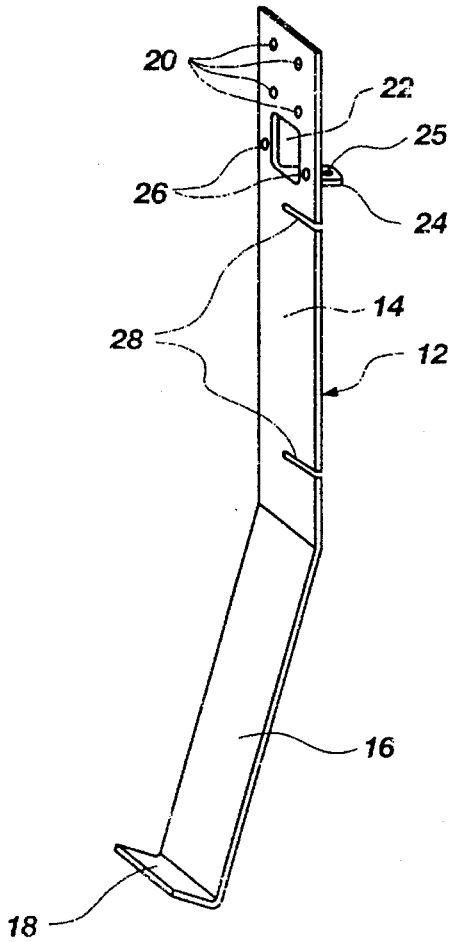
FIG. 2 is a perspective view of an anchor strap for use as shown in FIG. 1 with the framing anchor system of the present invention.

Referring now to FIGS. 1 and 2 of the drawings, the framing anchor system 10 of the present invention will be described. It should be noted at the outset that framing anchor system 10 is generally based upon a thermal insulation system for slab-type buildings as described and claimed in U.S. Pat. No. 4,524,553, issued to the inventor named herein. The disclosure of the '553 patent is hereby incorporated herein by this reference.

The slab insulation system of the '553 patent is marketed as the INSU-FORM® system, was not designed nor intended to provide high-strength frame anchoring capabilities, and does not form a part of the present invention. The present modifications and improvements to this system do, however, afford major improvements in frame anchoring strength, and such modifications and improvements in combination with portions of the prior art structure as disclosed in the '553 patent do, in fact, comprise a portion of the present invention.

Framing anchor system 10 includes an anchor strap 12, which in a preferred embodiment is formed of a twelve-gauge galvanized iron strap eighteen inches long and 1½" wide (see FIG. 2). Strap 12 is bent ten inches from the top at approximately a 20° angle to define an upper segment 14 and a lower segment 16, the bottom one inch 18 of the angled lower segment 16 being further bent in the same direction as the original bend angle to an orientation of 90° to the rest of lower segment 16. The upper segment 14 includes four ⅛" stud anchor holes 20 in a rectangular pattern, spaced inwardly ½ from the sides of strap 12 and ½" laterally and 1" vertically, the uppermost holes 20 being ½" from the top of the strap. Below holes 20 is punched a 1" aperture 22, the top of which lies 2" from the strap top, the strap material punched from aperture 22 being bent outwardly at the bottom of aperture 22 from the plane of major segment 14, 90° in the opposite direction of the bend of lower segment 16 to form tab 24. Tab 24 has a single, centered ⅛" hole 25 formed therein ¼" from the free end. Flanking aperture 22 and centered between the upper and lower extent thereof as well as in the strap material on each side of aperture 22 are ⅛" track anchor holes 26. At 3½" and 8⅝" below the top of strap 12 lie ⅛" wide, ¾" deep transverse slots 28.

Referring now to FIG. 1, in light of the description of anchor strap 12 with respect to FIG. 2, anchor strap 12 is shown in place on footing 30 as a part of framing anchor system 10. Footing 30 is of poured concrete which has rebar 32 and 34 horizontally disposed therein oriented parallel to the footing 30 and perpendicular to the plane of the drawing sheet. Shown in broken lines at 36 is a six-inch long, ½" diameter J-bolt disposed in the concrete, with its threaded upper end protruding above the flat footing top 38. An angled bracket 40, such as is described in the aforementioned '553 patent, is also shown in broken lines, J-bolt 36 extending through apertures 42 and 44 therein, with the hook of the J extending toward the interior of the footing 30. Rebar 32 lies between the shaft of J-bolt 36 and the apex 46 of bracket 40. At the end of each leg 48 and 50 of bracket 40, outwardly-extending feet 52 and 54 protrude beyond the vertical exterior face 56 of footing 30. Strap 12 engages feet 52 and 54 via slots 28, and the upper segment 14 lies substantially flush with vertical footing face 56. Lower segment 16 of strap 12 extends into footing 30, wherein it engages rebar 34, the lowermost 90°-angled portion of lower segment 16 extending thereunder.

Upwardly-facing sole blocking track 60 of "C" cross-section lies with its base 62 on footing top 38, J-bolt 36 protruding through an aperture 64 formed therein, and nut 37 holding track 60 to footing 30. Outer flange 66 of track 60 is secured to anchor strap 12 by two self-tapping screws 68 extending through track anchor holes 26 and through flange 66. Metal "C" section stud 70 rests on sole blocking track 60, extending vertically upward therefrom. Stud 70 is secured to anchor strap 12 by four self-tapping screws 68 extending through stud anchor holes 20 and into outer flange 72 of stud 70. It should also be noted that at least one and usually both of the screws 68 employed to anchor track 60 also extend into and through stud flange 72. Thus, track 60 and stud 70 are securely anchored at multiple points to footing 30, as well as to each other. Anchor system 10 is preferably placed on 24" centers so as to engage each and every stud 70, the top of J-bolts 36 lying within the span of the stud flanges 72 and 74.

Tab 24 and feet 52 and 54 are used to engage a horizontally-extending, 6" twenty-gauge unpunched metal stud 80 as shown in broken lines in FIG. 1, the interior of stud 80 being filled with a foam insulation 82 to insulate footing 30. A screw 68 secures stud 80 to each strap tab 24, and the stud flanges 83 and 85 engage feet 52 and 54, respectively. A weep screed (not shown) may be placed over the upper edge of stud 80 to direct rainwater. Below stud 80 may be disposed foam insulation board 84, extending down to the frost line or as desired. Above horizontal stud 80 extends foamed cement block 100, shown in broken lines, the configuration and arrangement of which will be described in more detail with respect to other drawing figures. On the exterior of block 100 is disposed a synthetic elastomeric exterior stucco such as is known in the art. Metal stud 80 may be covered with expanded metal lath and the stucco extended down over it, or it may be merely covered with an elastomeric copolymer brushable sealant.

Figure 3C:
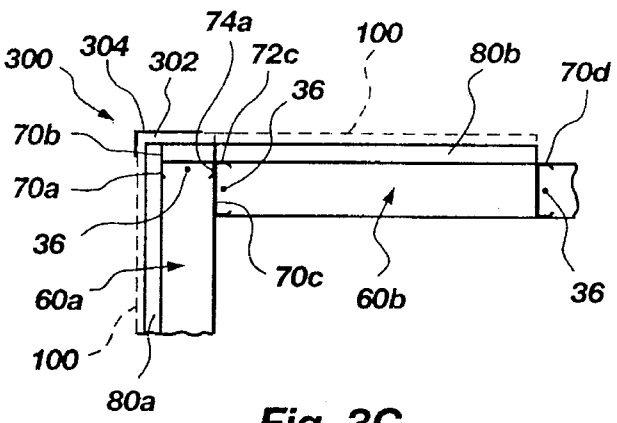
FIG. 3C is a top elevation of the corner configuration depicted in FIG. 3.
Figure 3:
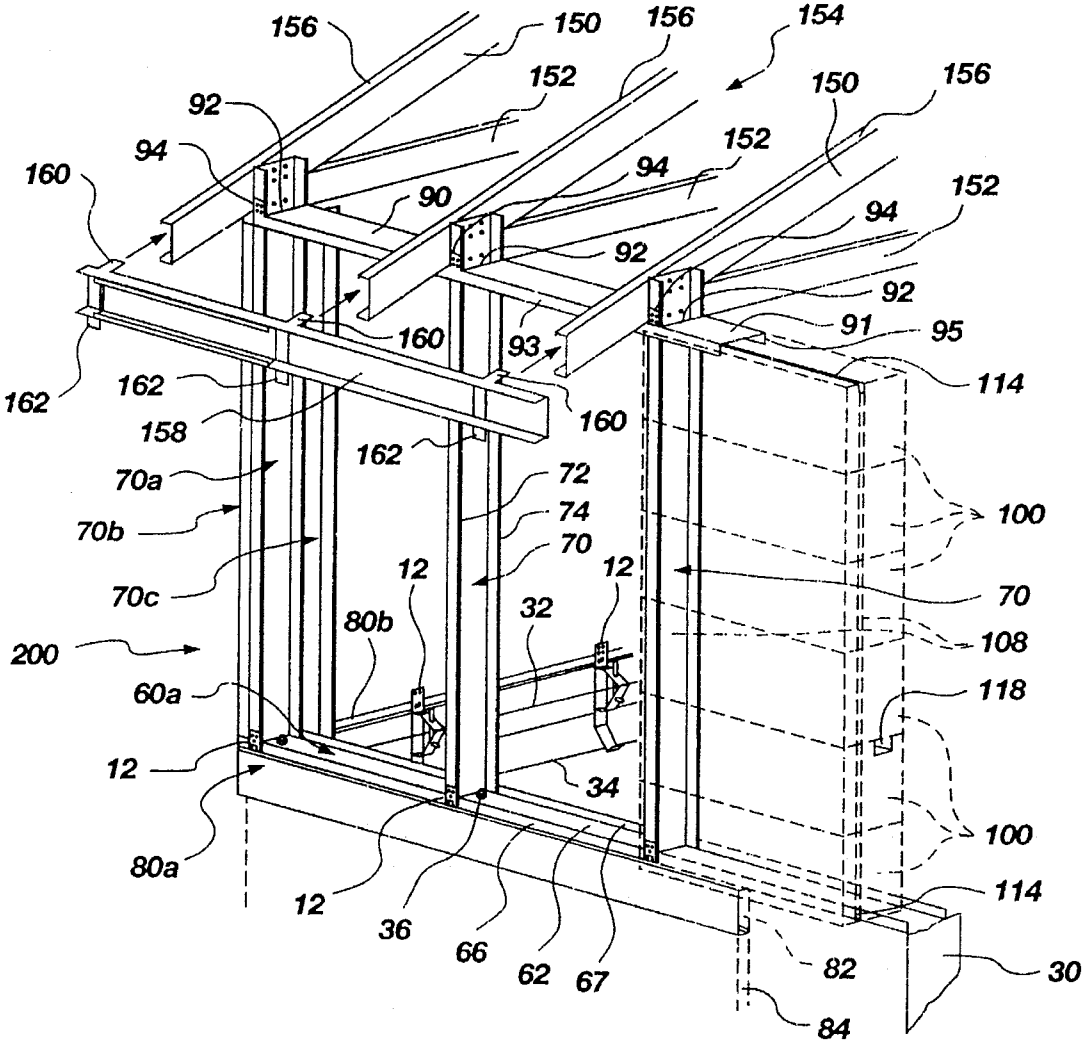
FIG. 3 is a perspective view of the framing system of the present invention as employed in a single-story structure in combination with the insulating system of the present invention.
Figure 3A:
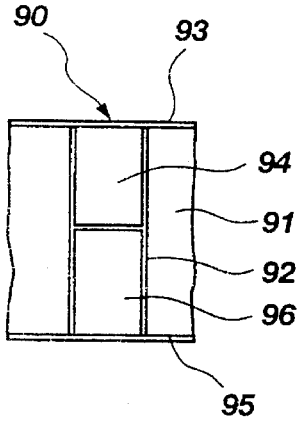
FIG. 3A is a top elevation of a blocking track in which an "H" cut has been made to provide an aperture for receiving a stud and fastener tabs.

Referring now to FIG. 3 of the drawings, a one-story variation of metal framing system 200 of the present invention is depicted. In describing elements depicted in FIG. 3 which have been previously identified in FIGS. 1 and 2, like reference numerals will be employed to avoid confusion. Footing 30 supports sole blocking track 60, which is anchored thereto as previously described using straps 12 and J-bolts 36, horizontal insulating stud 80 being supported on the footing exterior. A plurality of vertical studs 70, also anchored to the footing as previously described, rests on and within track 60 between outer and inner flanges 66 and 67, respectively. Both studs and track are preferably of twenty-gauge steel, and 6" nominal width, it being understood as previously noted and as depicted in the drawing figures that studs 70 fit within the flanges of track 60. Studs 70 extend upwardly into and through cap blocking track 90, which has apertures 92 cut therein. Cap blocking track 90 is identical to sole blocking track 60, but is reverse-oriented with its flanges 93 and 95 extending downwardly from the base 91. As shown in FIG. 3A, apertures 92 are cut in an "H" pattern so that tabs 94 and 96, when bent outwardly from the plane of the track base 91, provide a means to secure studs 70 thereto (see FIG. 3) by screws extending through tabs 94 and 96 and into outer and inner stud flanges 72 and 74, respectively.

Steel roof rafters 150 and joists 152, which may be erected individually or as part of a prefabricated roof tress 154, rest on cap blocking track 90 and are secured to the uppermost ends of studs 70, again by screws. Roof decking (not shown) may then be secured to rafters 150 via screws engaging upper flanges 156 of the rafters 150, and conventional roofing materials applied to the decking. Other structural elements, such as end plates 158, may also be formed of "C" section members cut at suitable intervals with an "H" cut and secured via screws using tabs 160 and 162 resulting from the "H" cut.

FIG. 3C of the drawings depicts the corner construction as also shown in FIG. 3, but from the top. As can be seen, at corner 300 back-to-back vertical studs **70*a* and 70*b* are employed at the end of one wall, and the adjacent wall, extending at 90° to the first, commences with another vertical stud 70*c* oriented so that its base abuts the flange 74 of stud 70*a*. All these studs (70*a*, 70*b* and 70*c*) are secured together by screws and stud 70*a* is also secured to a strap 12 and sole blocking track 60*a*, to which stud 70*b* may also be secured. Stud 70*c* rests within sole blocking track 60*b* (at fight angles to track 60*a*), and may also be secured to a strap 12 as well as to sole blocking track 60*b***.

While not depicted, it will be appreciated that other framing components, such as header tracks, etc., may be secured to studs 70 using self-tapping screws to define window openings and doorways, and that window and door assemblies may be secured to the framing structure via screws, with foam or other suitable insulation disposed to close all gaps therebetween against heat loss or gain and air infiltration. Conventional window and door assemblies may be employed with no modifications, it being preferred, of course, that insulating (dual or triple-pane) windows and foam-core doors be employed.

Figure 5:
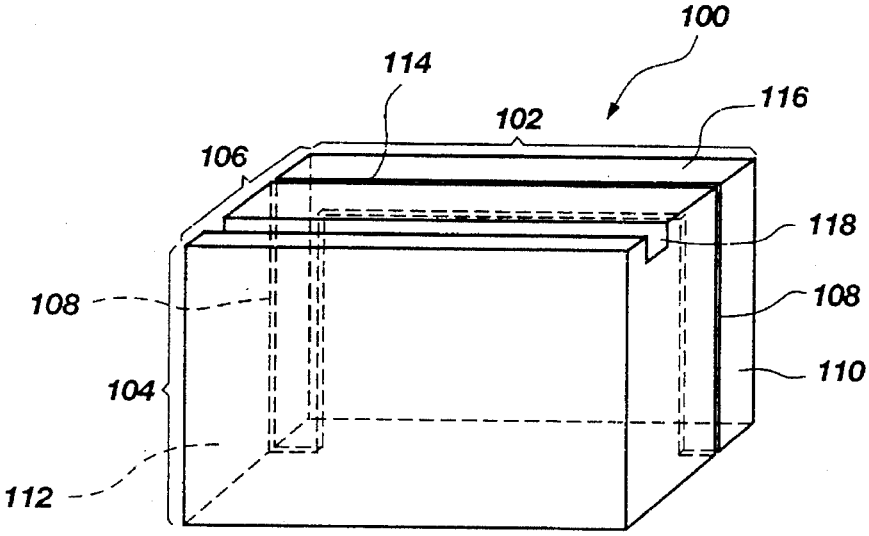
FIG. 5 is a perspective view of a foamed cement insulating block according to the present invention.

Referring now to FIG. 5 of the drawings, foamed cement insulating block 100 will be described in detail. Foamed cement blocks may be of any suitable foamed cement material, such as aerated cement, cement which includes gas bubbles or cells formed by a chemical reaction as the block material is mixed, or cement foamed by the introduction of a separate foaming agent into the block material during mixing, all as known in the art. The preferred block material is provided by Omega Transworld, Ltd. of New Kensington, Pa. The Omega Transworld block is formed of portland cement, fly ash and polyester, which affords a uniform, closed-cell structure possessing excellent insulating characteristics in combination with being light weight. The Omega Transworld block material was originally developed for use in blocks employed in controlling ventilation in subterranean mines where air penetration is of the utmost importance. However, the basic Omega Transworld block material, offered in the OMEGA™ block for such mining applications, has been specifically configured for use with the framing system 200 of the present invention. The resulting insulating block 100 is thus considered to be a part of the building system of the present invention.

Block 100, when sized for use with the 24" O.C. framing system 200 as previously described, is of 23½" length 102, 16" height (oriented as installed) 104, and 8" depth 106. A ¼" groove 108 of 1½" depth is formed in at least one side 110 of block 100 with its inner edge 2¼ from the outer surface of the block as installed. A similar groove 108 may be formed on the other side 112, depending upon the exact embodiment of the framing system 200 employed, as will be further described. Another ¼ groove 114 of 1½" depth may be formed on a surface 116 of block 100, which surface may be the top or the bottom of the block, as installed. The aforementioned grooves, if all are employed, are contiguous. The purpose of groove 14 is to receive an outer leg of a sole or cap blocking track 60 or 90, respectively. Thus, groove 114 is required only in the uppermost or lowermost blocks of a stack. Another, deeper and wider groove 118 (such as a 2"×2" cross section) may be formed in some of the blocks 100, typically those on the second or third level or row from the bottom of the wall, defined by the sole blocking track 60. Groove 118 is used to accommodate electrical wiring running to outlet boxes on the interior wall of the structure, and so is generally formed at a distance from the interior block surface (as installed) to communicate with such a box when cut in and installed in the block.

Figure 3B:
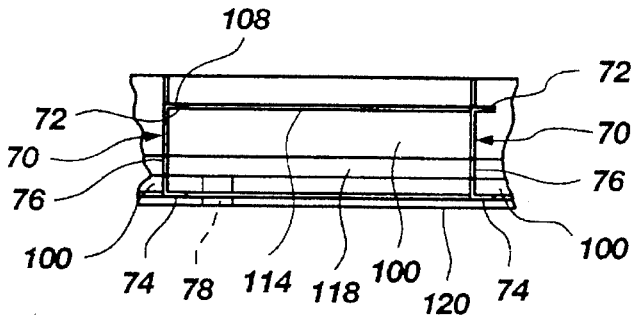
FIG. 3B is a top elevation of a segment of a one-story wall framed and insulated according to the present invention.

Referring again to FIG. 3 of the drawings, a stack of blocks 100 is shown in broken lines as installed with framing system 200. As shown, outer flange 72 of the right-hand most stud 70 depicted in FIG. 3 is received in a groove 108 of each block in the stack. The opposite side grooves are not utilized, as the side 110 shown in the drawing abuts the base or back of the next adjoining stud 70 (not shown). A top view of this wall arrangement is depicted in FIG. 3B. The lowermost block 100 includes a groove 114 on its lower surface to received the outer flange 62 of sole blocking track 60. A clearance cavity may be cut in the bottom of each lowermost block 100 to accommodate the protruding head of J-bolt 36 and its nut 37. The uppermost block 100 includes a groove 114 on its upper surface to engage outer flange 93 of cap blocking track 90. Thus, blocks 100 as installed protrude 2" beyond the studs 70 and extend over outer flange 72 thereof so that each column of stacked blocks is closely adjacent the next stack, substantially coveting the stud exteriors, but for a vertical gap of less than about ¼". The vertical gaps or joints between the adjacent block stacks may be easily covered by a skim coat of an acrylic elastomeric patching compound or other suitable filler and the entire wall then finished with a synthetic elastomeric stucco, as previously noted. The interior of the stud wall may be covered with drywall 120 (see FIG. 3B) using screws (not shown) to secure the drywall 120 to the inner flanges 74 of the studs, outlet and switch box openings being cut in the drywall for access as with conventional constructions. Electrical conduit groove 118 which is also depicted in FIGS. 3 and 3B, is aligned with apertures 76 drilled or otherwise formed in studs 70 and communicating with box openings 78 extending through the block material and the drywall (see FIG. 3B). Drywall may also be applied with screws to the flanges on the underside of roof joists 152 in the same manner as to the studs.

Referring again to FIG. 3C of the drawings, blocks 100 are shown extending (broken lines) beyond and above foam-filled horizontal metal studs **80*a* and 80*b* except in the immediate vicinity of corner 300. Horizontal stud 80*b* may be extended under vertical stud 70*b* to abut horizontal stud 80*a* at corner 300. Stud 70*b* may be foam-filled if desired, and corner area 302 where no blocks 100 are located finished with a cement stucco or other suitable filler to match up to the protrusion of blocks 100 adjacent the corner 300. An elastomeric stucco finish coat 304 is then applied over both blocks 100 and corner area 302. It can thus be seen that structure corners 300** will be equally well insulated as the rest of the structure employing the present invention, while maintaining the same high degree of structural strength.

While blocks 100 used at corner 300 as illustrated are oriented with their longest dimension 102 horizontally, since all spaced studs 70 are placed at 24" O.C., it should be understood that (for example and not by way of limitations) vertical stud **70*d* might be placed 16" O.C. with respect to stud 70*c*, and blocks 100 stacked tipped on end to accommodate this spacing, grooves 114 thus engaging outer flange 72*c* of stud 70*c*. A groove 108 in the top and bottom blocks 100 of that stack would then engage sole and cap blocking track outer flanges. With such an arrangement, if stud 70*d* is oriented to face corner 300, stud 70*c* could also be eliminated, and the structure still maintain at least 24" O.C. vertical framing. Thus, an accommodation to stud spacing other than 24" O.C. may be made without altering the basic block dimensions. Of course, where desired or required, block 100** may be easily trimmed and grooved on site to fit small or odd-shaped wall cavities between framing members.

Using blocks 100 as integral wall components with framing system 200 results in a highly thermal- and acoustic-insulated structure with substantially no air infiltration, the steel frame and foamed cement blocks being extremely fire-, rot- and termite-resistant as well as resistant to other pests such as rodents. While the framing system provides interlocking of the framing members, the interposed, snugly fitting blocks which interlock with studs and blocking plates provide additional stiffness and torsional and flexure resistance to the assembled framing members so that they might better withstand high winds and earthquakes. It should be understood that the assembled framing and block system does not produce a completely rigid structure, but one that will "give" in response to forces, the blocks providing limited twisting and flexure of the framing members while limiting same and acting as vibration damping elements. Further, it has been demonstrated that the mass of the stacked block walls provides a thermal mass to moderate interior temperature swings in comparison to those on the exterior of the building, provided greater comfort to the inhabitants and reducing heating and cooling demands in the same manner as an adobe or solid masonry dwelling, but with the obvious added advantage of the closed-cell insulative structure of the block.

Figure 4:
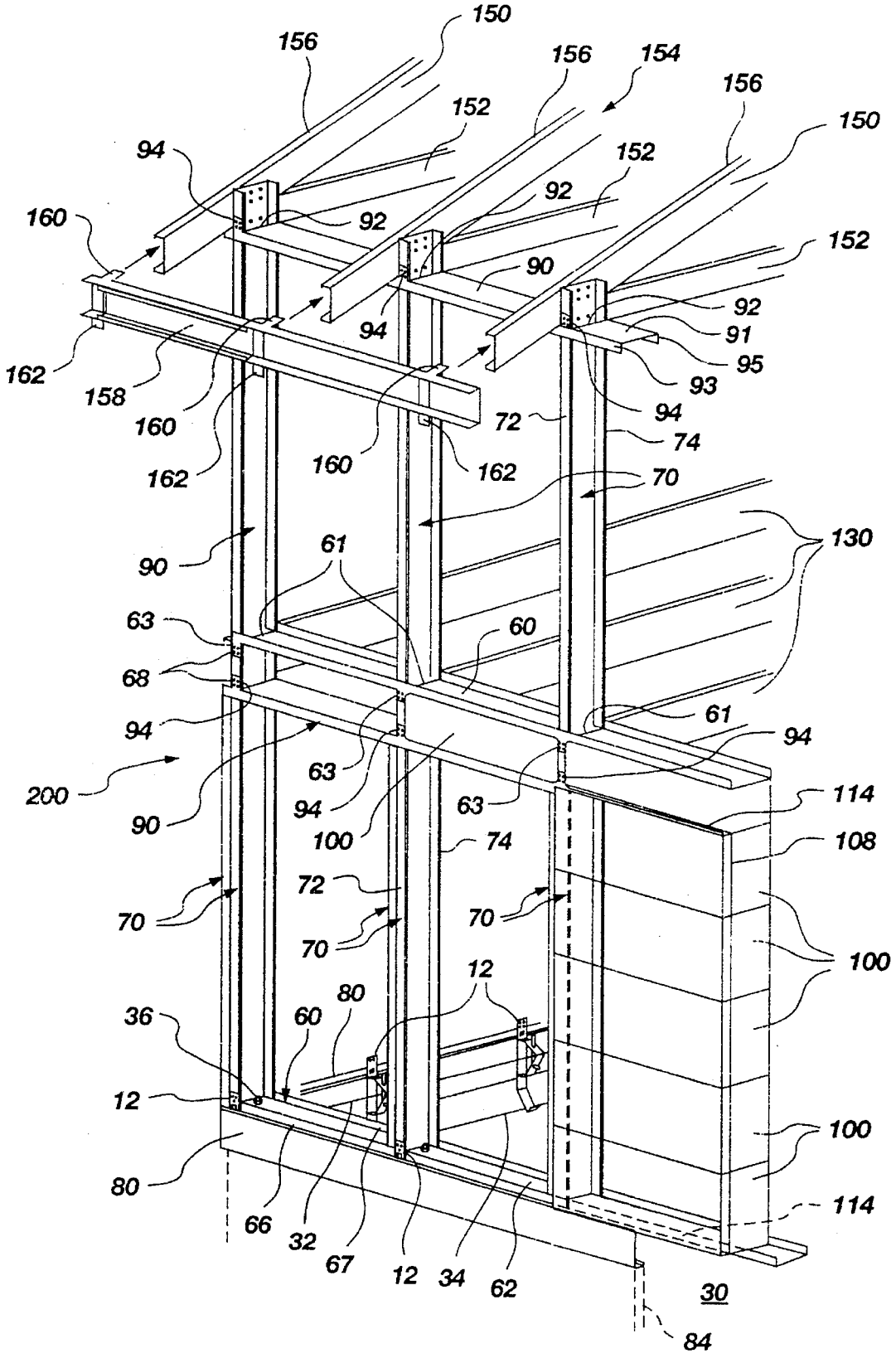
FIG. 4 is a perspective view of the framing system of the present invention as employed in a two-story structure in combination with the insulating system of the present invention.
Figure 4A:
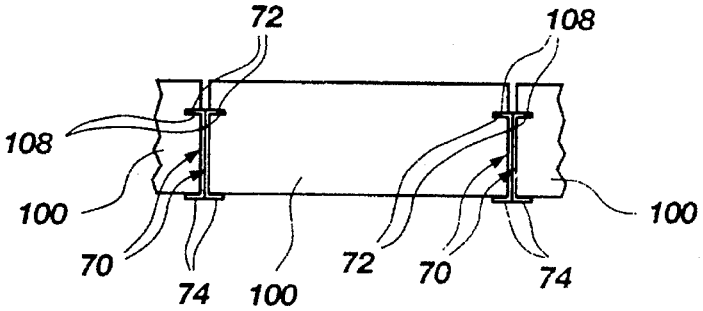
FIG. 4A is a top elevation of a segment of the first-story wall of a two-story structure according to the present invention.

Referring now to FIG. 4 of the drawings, a two-story structure using the framing system of the present invention is depicted. The two-story variation of framing system 200 differs from the previously-described one-story variation as follows. The lower story employs back-to-back studs 70 "C" cross-section which are secured to each other by screws. Thus, inner 74 and outer 72 flanges of the studs 70 thus extend outwardly from the stud bases in both lateral directions, and blocks 100 of the lower story engage outer flanges 72 of studs 70 via grooves 108 on both sides, instead of just one. A top view of this arrangement is shown in FIG. 4A.

One of each pair of studs 70 terminates beneath the cap blocking track 90 for the first story, while the other extends upwardly through an aperture 92 in the track, and through H-cut apertures 61 in a second story sole blocking track 60 spaced above the first story cap track 60 the height of floor joists 130, which are secured via screws to the stud extending through the first story cap track 90. Second story sole blocking track 60 is also secured to the same extended studs 70 via screws through tabs 63 and 65 (hidden).

Blocks 100 may be cut down in height to fill the cavity between the lower cap track 90 and the upper sole track 60. Blocks 100 for the second story engage studs 70 on only one side as with a single-story structure. The roof rafters, joists, trusses, etc. are secured to the structure of FIG. 4 in the same manner as that of FIG. 3. Likewise, door and window openings are formed in a two-story structure in the same manner as the one-story version, the drywall is applied in the same manner, and the structural details previously described are the same in all other respects.

It is contemplated that the frame anchoring system, framing system and insulating system as previously described may be applied to structures of more than two stories, structures with crawl spaces or basements instead of slabs, and structures employing various siding systems such as wood, vinyl, steel and aluminum siding, as well as brick or stone, if desired. Roofing materials and designs may also be varied as desired. Attic insulation may be conventional fiberglass disposed as batts or rolls, blown-in rock wool, foam or any other material including that of the blocks 100 if desired. The block material may be cast in dimensions to fit between rafters, and back-to-back "C" section rafters used so as to hold the roof blocks between the rafter flanges for cathedral ceilings. A lighter-weight, foamed cement block may be produced for this application, such block still affording high rigidity and fire-resistance.

As previously noted, the building system of the present invention may be erected with only hand tools such as are used in conventional construction, and the construction techniques are so similar to those already employed in the trade that little additional training of personnel is required. Both framing members and blocks may be readily trimmed as desired or required for placement anywhere in the structure. Conventional carbide saw blades may be used for cutting both such structural elements, and the use of electrically powered drills and saws is contemplated to speed construction as with conventional building systems. Overall labor and material costs and construction time are the same or less than that of conventional construction, and a structure according to the present invention is, when closed in, sufficiently well insulated in most climates that heating costs during the lengthy interior finishing process are negligible. Furthermore, once closed in, the structure according to the present invention affords much greater security than conventional construction, providing advantages to the contractor against pilferage as well as to the ultimate occupants of the home.

While the present invention has been described in terms of a certain preferred embodiment, it will be readily apparent to those of skill in the art that it is not so limited. Many additions, deletions and modifications to the invention as disclosed herein may be effected without departing from the scope thereof as hereinafter claimed. For example, aluminum framing members may be employed. Insulating blocks of mixed vermiculite and concrete or of mixed preformed styrofoam particles and concrete may be substituted, as might adobe blocks, although such alternatives are not preferred. The blocks may be formed with internal reinforcing structures, such as glass fibers or metal or fiberglass mesh, although this is not required.

What is claimed is:

1. A building system for habitable structures, comprising:

a plurality of vertical, laterally spaced sheet metal studs, each having a flat, continuous base;

a horizontal sheet metal sole blocking track supporting and secured to the bottom of each stud with said bases of said studs extending transversely across said sole blocking track;

a horizontal sheet metal cap blocking track above said sole blocking track supported by and secured to each stud;

a plurality of substantially rectangular insulating blocks, each including two substantially parallel ends, said blocks being vertically stacked between at least two laterally adjacent studs, said block stack extending substantially from said sole blocking track to said cap blocking track, said insulating blocks each including a vertical, exterior groove in at least one end thereof engaging at least one of said at least two adjacent studs, said blocks being dimensioned to fit snugly between said at least two adjacent studs with said block ends substantially abutting said stud bases.

2. The building system of claim 1, wherein said studs and said blocking tracks are of a "C" cross-section, having a base and two perpendicularly extending flanges.

3. The building system of claim 2, wherein said studs fit within said blocking track flanges.

4. The building system of claim 2, wherein said flanges of one of said at least two adjacent studs are oriented toward the other of said at least two adjacent studs, and said at least one groove in said blocks engages a stud flange of said one stud.

5. The building system of claim 2, wherein the flanges of said at least two adjacent studs are oriented toward each other, and said blocks include grooves engaging the flanges of both of said at least two adjacent studs.

6. The building system of claim 2, wherein said sole blocking track is oriented with its flanges facing upwardly, and said block adjacent said sole blocking track includes a groove along a bottom surface thereof engaging a flange of said blocking track.

7. The building system of claim 2, wherein said cap blocking track is oriented with its flanges facing downwardly, and said block adjacent said cap blocking track includes a groove along a top surface thereof engaging a flange of said blocking track.

8. The building system of claim 1, wherein at least some of said studs extend through apertures in said cap blocking track.

9. The building system of claim 8, wherein at least some of said apertures are formed by making an "H" shaped cut in the base of said cap blocking track perpendicular to the longitudinal axis of the track so as to define first and second tabs, and bending said tabs outwardly to a position perpendicular to the plane of said base.

10. The building system of claim 9, wherein at least some of said studs are secured to at least some of said cap blocking track tabs.

11. The building system of claim 10, wherein at least some of said studs extend substantially above said cap blocking track, through a second sole blocking track thereabove, and through a second cap blocking track above said second sole blocking track.

12. The building system of claim 11, wherein said second sole blocking track and said second cap blocking track receive at least some of said studs through apertures therein formed by making an "H" shaped cut in the base of each of said blocking tracks perpendicular to the longitudinal axis of that track so as to define first and second tabs, and bending said tabs outwardly to a position perpendicular to the plane of said base.

13. The building system of claim 12, wherein at least some of said studs extending through said second blocking tracks are secured thereto by at least one of said tabs.

14. The building system of claim 11, further including horizontal floor joists disposed between said cap blocking track and said second sole blocking track and secured to said studs extending therethrough.

15. The building system of claim 8, further including roof rafters supported by said cap blocking track and secured above said cap blocking track to said studs extending through said cap blocking track.

16. The building system of claim 1, wherein said block stack protrudes horizontally beyond said studs on one side of said blocking tracks.

17. The building system of claim 16, wherein said horizontal protrusion of said block stack is placed to define the exterior of a structure.

18. The building system of claim 16, wherein said block stack lies substantially flush with said studs on the other side thereof.

19. The building system of claim 18, further including drywall secured to said studs over said blocks on said other side.

20. The building system of claim 1, further including a horizontal conduit groove in one of said blocks of said stack extending between said at least two adjacent studs and communicating with apertures formed through said studs for receiving electrical wiring therethrough.

21. The building system of claim 20, further including an aperture in one side of said block which includes said conduit groove, said aperture being in communication with said conduit groove.

22. The building system of claim 1, wherein said insulating blocks comprise foamed cement blocks.

* * * * *

UNITED STATES PATENT AND TRADEMARK OFFICE

CERTIFICATE OF CORRECTION

PATENT NO. : 5,596,860
APPLICATION NO. : 08/304011
DATED : January 28, 1997
INVENTOR(S) : John H. Hacker It is certified that error appears in the above-identified patent and that said Letters Patent is hereby corrected as shown below:

On the title page:

In ITEM (56) References Cited

U.S. PATENT DOCUMENTS change "4,052,829 10/1977 Chopman 52/285"
to --4,052,829 10/1977 Chapman 52/285--
change "4,924,641 5/1990 Gibbar"
to --4,924,641 5/1990 Gibbar, Jr.--
change "5,274,973 1/1994 Liong 52/667 X"
to --5,274,973 1/1994 Liang 52/667 X--

In ITEM (57) ABSTRACT after "tracks" and before "physically" insert --are--

In the specification:

| | | |
|---|---|---|
| COLUMN 2, | LINE 49, | change "J-bolts which" to --J-bolts, which-- |
| COLUMN 4, | LINE 64, | change "segment 14," to --segment 14-- |
| COLUMN 7, | LINE 21, | change "groove 14" to --groove 114-- |

Signed and Sealed this

Thirteenth Day of October, 2009

David J. Kappos

David J. Kappos
*Director of the United States Patent and Trademark Office*